US006279297B1

(12) United States Patent
Latronico

(10) Patent No.: US 6,279,297 B1
(45) Date of Patent: Aug. 28, 2001

(54) PROCESS FOR THE PRODUCTION OF A HERMETIC RECLOSEABLE PACKAGE OF FLEXIBLE MATERIAL

(75) Inventor: Mario Latronico, Treviolo (IT)

(73) Assignee: BG-Pack S.R.L., Treviolo BG (IT)

( * ) Notice: Subject to any disclaimer, the term of this patent is extended or adjusted under 35 U.S.C. 154(b) by 0 days.

(21) Appl. No.: 09/297,474

(22) PCT Filed: Oct. 20, 1997

(86) PCT No.: PCT/EP97/05771

§ 371 Date: Apr. 29, 1999

§ 102(e) Date: Apr. 29, 1999

(87) PCT Pub. No.: WO98/18678

PCT Pub. Date: May 7, 1998

(30) Foreign Application Priority Data

Oct. 31, 1996 (IT) ..... MI96A2281

(51) Int. Cl.[7] ..... B65B 61/18
(52) U.S. Cl. ..... 53/412; 53/463; 53/139.2
(58) Field of Search ..... 53/412, 463, 133.3, 53/461; 206/440; 383/210, 211

(56) References Cited

U.S. PATENT DOCUMENTS 2,922,342 * 1/1960 Chalmers et al. ..... 53/412
3,022,613 2/1962 Powers .
3,062,371 * 11/1962 Patience ..... 206/440
3,320,863 * 5/1967 Ellis ..... 53/412
3,338,019 * 8/1967 Trewella ..... 53/412
3,685,720 * 8/1972 Brady ..... 383/210
3,761,013 * 9/1973 Schuster ..... 383/210
3,998,135 * 12/1976 Sargent ..... 53/412
4,941,307 * 7/1990 Wojcik ..... 53/412

FOREIGN PATENT DOCUMENTS 2939791 4/1981 (DE) .

* cited by examiner

*Primary Examiner*—John Sipos
(74) *Attorney, Agent, or Firm*—Collard & Roe, P.C.

(57) ABSTRACT

A process for the production of a hermetic re-closeable package suitable for various products, in particular food products (4), which consists in partly overlapping two (1,2) sheets of flexible material in order to define two longitudinal side edges (1*a*,2*a*) overlapping each other, in joining the two edge regions in such a way as to make them separable and recloseable, in locating the product on said sheets, with one side located next to the edge regions sealed in such a way that they are separable, thereafter in wrapping the so joined sheets around the product by sealing one to the other the side edges opposed to the edges among them already joined; in joining the opposed free ends of such sheets and in sealing them so as to form two end seals; an air-tight packaging is thus produced, openable and recloseable after each partial drawing of product through the opening made by separation and raising of the edge region from the underlying one. The invention also provides an apparatus for carrying out said process.

6 Claims, 4 Drawing Sheets

PROCESS FOR THE PRODUCTION OF A HERMETIC RECLOSEABLE PACKAGE OF FLEXIBLE MATERIAL

BACKGROUND OF THE INVENTION

1. Field of the Invention

The present invention relates to a process for the hermetic packages of various products, in particular food products, inside an envelope of flexible material, openable and re-closeable after each partial drawing of the product.

An apparatus for carrying out such process is a further object of the invention.

2. The Prior Art

As known, there are various types of air-tight packages currently available, in particular for easily perishable food products, consisting of envelopes generally of flexible material able to exclude the exposure of the product to the open air and at the same time to allow that the packaged product be recognised through inscriptions, designs and figures reported on the envelope. It is also known that the current air-tight envelopes for food products made of plastic material, cardboard and the like, while, on one side, have the advantage of resulting long lasting and of securing the air-tightness, on the other side, they turn out to be difficult to open, requiring for this operation the employment of scissors and knives, which can come out to be dangerous.

Moreover, the current hermetically sealed envelopes have the drawback that they cannot be re-sealed once they are opened to allow the partial drawing of the product. In the practice, this forces the user to seek expedients to try to close the product as hermetically as possible after each drawing, such as, for example, folding the open side of the package over itself, or wrapping the package inside plastics films or other sort of envelopes.

The possibility of using laminated plastics films or sheets for carrying out the air-tight wrapping of products of various types is also known; in such cases, an edge region of laminated film, closing the opening made in the envelope of the packaging carried out by means of the film itself, can be separated by detaching the same edge of the envelope as it were a peel; this hermetic packaging system is known in the packaging industry as "inside to outside sealing".

It is known in fact that the laminated plastics film is able to seal two overlapping layers of the same film by mutual adhesion, which layers can be separated from each other to open a package and re-seal it again, after each partial drawing of the product therein contained.

The only serious drawback present in the envelopes carried out by laminated and separable films is that they allow the formation of envelopes in an shape and size unique to each single type of products, in that the apparatuses currently employed for producing such a kind of packaging do not permit to produce different types of packages; said apparatuses have to undergo in fact conversions and structural modifications as well as regulations for producing the envelopes in different shapes and sizes, in order to adapt them to the various products.

DE-A-2939791, Beck, discloses a process for the production of a small bag which can be opened and closed again containing the product to be packed, characterised in that a thread of adhesive is stuck onto a first sheet, that a second sheet is applied on the first sheet, that the ensemble constituted by the first and the second sheet joined together is joined to a third sheet on which the product to be packed is placed; the ensemble is joined to the third sheet by means of two joints, an upper joint at the top of the bag and a lower joint at the bottom of the bag; finally the bag is sealed on the sides by means of a seam.

The apparatus for carrying out the process is constituted by a first spool from which the first sheet unfolds, by a second spool for the second sheet and by a third spool rotating in opposite direction, for the third sheet.

The bag obtained is provided with an upper sealing line joining the second sheet to the third sheet, a lower sealing line joining the first sheet to the third sheet and an adhesive line joining the second sheet to the first sheet.

U.S. Pat. No. 3,022,613, Powers discloses a process for packaging a product comprising forming a continuous envelope from a continuous wide web of heat-sealable sheet, formed by longitudinally folding the web on a longitudinal fold line to provide a first and a second superimposed walls, integrally joined, and providing a marginal portion which is folded on a longitudinal fold line constituting a flap-forming portion.

According to a variation of the process the envelope is formed from two individual webs of the same material, heat sealing the webs along an edge of the envelope, so forming a lower joint at the bottom of the envelope. According to another variation, the envelope is formed from two individual webs and a tape, each of heat sealable sheet, heat sealing the webs and the tape, so forming a lower joint at the bottom of the envelope and an upper joint at the top of the envelope.

SUMMARY OF THE INVENTION

An object of the present invention is therefore to afford an industrial process for forming air-tight envelopes, openable and re-closeable after each partial drawing of the product, conceived in such a way as to allow the production of packages of various shapes and sizes in an easy and reliable way, thus eliminating the limitations of use present in the current production methods for air-tight envelopes and allowing to produce openable and hermetically re-closeable envelopes, without employment of cutting tools and the like. Another object of the present invention is to carry out a method of packaging for various products able to employ every sort of sheets within packaging material of flexible type, such as plastics, paper, cardboard, metallised foil and the like.

A further object of the invention is to offer a process such as that described above, which is conceived in such a way as to be carried out more or less integrally over the machines currently employed in the packaging industry, and more precisely, such as not to require particular conversion procedures in the sealing and/or sizing displays and in the regulation means of said current machines for modifying the volume and the shape of the sealed enclosure constituting the requested packaging.

These and other further objects, which will be more clearly hereinafter evidenced, are reached through a process for the application of an air-tight wrapping material around a solid product of various shape and consistency, in order to substantially obtain a package of flexible material for food products, openable and re-closeable after each partial drawing of the product, which process consists:

- in using two quadrangular sheets of different material as wrapping flexible material, of which at least one is laminated and of a material separable from the other sheet, having such a size as to allow the formation of an enclosure in pre-defined sizes;
- in locating said two sheets in a partly overlapping position in two adjacent and parallel planes, so as to allow a first longitudinal side edge of the first sheet to overlap a first longitudinal side edge of the second sheet, thereafter in joining said first longitudinal side edges, so that they successively come out to be separable from each other, once the packaging is over, then in storing the product to be packaged in said partly overlapping and extended sheets and in folding the same sheets around the product until they partly overlap each other, leaving the two opposed side edges of the same sheets free and extended; then in tightly joining together said opposed first longitudinal side edges so as to partly wrap said product; then in folding the ends of the second extended side edges over each other, protruding from the opposed ends of the partly wrapped product, so as to allow them to be tightly joined and thus to form two opposed terminal closures, so as to obtain a substantially parallelepiped package, hermetically sealed, openable and re-closeable by separating and raising the exterior longitudinal first side edge with respect to the first edge region of the underlying sheet.

More particularly, the outermost of said first longitudinal side edges is joined with the underlying one by mutual adhesion or by means of a light sizing agent in such a way that it can be separated (and stuck up again) therefrom; it has moreover such an extent of overlap over the underlying edge region as to allow, by raising of said longitudinal outermost first edge region from the underlying one, to gain access to and to draw the product stored inside the packaging.

Moreover, it is preferable for said longitudinal first side edges, peelable from each other, to be stored and joined together near a corner or side edge of the package, in such a way that, by peeling the outermost of the edge region and by folding the underlying edge region to the interior, they gain full length, width or depth access to the product. Still according to the present invention, for carrying out said method of forming a hermertically sealed package, openable and re-closeable, there is provided an apparatus which can be associated upstream of an already known packaging apparatus, and more precisely, to an apparatus which already provides, for the formation of envelopes of flexible material such as plastics, paper, metallised foil and a combination thereof, a series of cascade-like cutting, forming, filling and sealing stations, arranged in a horizontal or vertical plane and able to join together the overlapping edge regions or side edges of sheets for packaging products through various systems, among which heat sealing, ultrasonic sealing, and even application of adhesives.

Therefore, the apparatus object of the present invention consists of, according to this discovery, a supporting frame to which two spools of flexible band or sheet of different material are associated, rolling around parallel axes, adjacent and staggered to each other in such a way as to allow a sheet unfolding over a plane from one of said spools to partly overlap the sheet unfolding from the other spool, in order to form two longitudinal side edges, overlapping each other, a braking mechanism being associated to each of said spools by contact on the unfolding sheet, said spools being moreover axially translatable the one to the other, in order to allow variations in the extent of the overlapping part or side edges, a sealing station of said overlapping edge regions being additionally provided, of the type which allows the separation of one edge region from the opposed one, as well as feeding means of the known type, aimed at transferring said partly overlapping and sealed sheets to the subsequent known stations of forming, filling with the product, cutting and sealing sheets to form the air-tight envelope around the product.

More particularly, said joint of the first longitudinal edge regions of the two sheets is preferably carried out by lap seal, whereas the joint between the second side edges of the same two sheets is carried out by the method known with the term of "fin seal".

In the same way, the joint of the transversal side edges of the same sheets which are located at 90° with respect to the longitudinal ones are folded and sealed so as to form end seals contained in a plane perpendicular to said transversal fin sealing.

Further characteristics and advantages of the present invention will be evidenced from the following detailed description of one of the possible embodiments thereof, made with reference to the attached tables of drawings, given by way of example only, and not limited, in which:

BRIEF DESCRIPTION OF THE DRAWINGS

FIG. 5 substantially shows the same section view of FIG. 4 but with the upper longitudinal edge region separate from the underlying one, thus evidencing the opening for the drawing of the product from the envelope which encloses it, whereas:

DETAILED DESCRIPTION OF PREFERRED EMBODIMENTS

With reference to said figures, and in particular to FIGS. 1 to 5, the process object of the invention provides the starting extension to the plane of two portions of rectangular band or sheets, indicated in the figures with 1 and 2, to whose opposed ends the edge regions or longitudinal strips 2*a*–2*b* for sheet 2 are defined, and the edge regions 1*a*–1*b* for the sheet 1, as well as the analogous edge regions to the opposed transversal ends, indicated with 2*c*–2*d* for the sheet 2 and with 1*c*–1*d* for the sheet 1, respectively.

Said sheets 1 and 2 are both made of flexible material such as plastics, paper, metallised foil or the like; preferably, one of said sheets is laminated and made of a material having such adhesive properties as to allow it to be separated from the other sheet and to be thereafter hermetically re-sealed.

Figure 1:
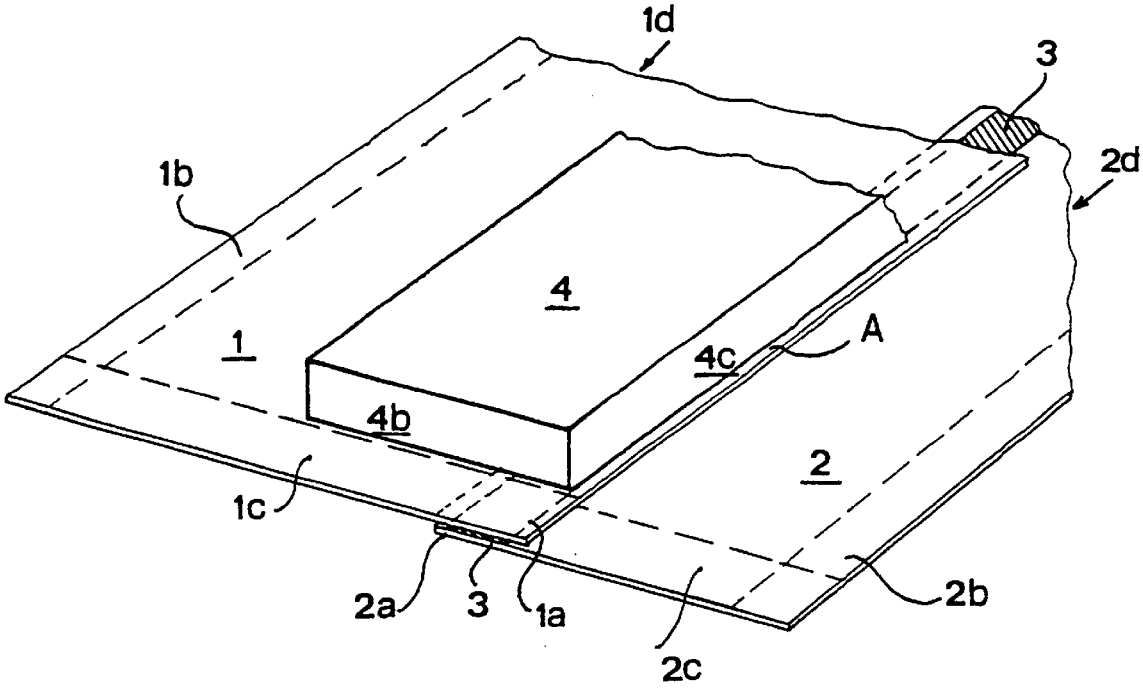
FIG. 1 is a diagrammatic illustration of the starting stage of the process for forming a re-closeable package according to the present invention.

FIG. 1 shows the first stage of the packaging production; therein the first two side edges 1*a* and 2*a* of the first and second sheets 1 and 2 respectively are overlapped, joining them together throughout their length by means of an adhesive means suitable to form a "lap seal" 3; it is necessary for the lap joint 3 to be next the corner 4*a* of the product 4, for example between one of the major sides 4*b* and one of the adjacent minor sides 4*c* of the product; that is to say, a longitudinal portion A shall protrude from the side 4*c* of the product for the reasons which will be explained afterwards.

The product 4 is stored on the sheets 1 and 2 at any suitable time in this stage of the packaging production; yet, as a rule, the product 4 is stored during or after the formation of the lap seal 3, with regard to the sort of consistency of the product itself. After locating the product 4, the sheets 1 and 2 are folded in such a way as to tightly wrap the product 4 as illustrated in FIG. 2, apart from the opposed ends of the product 4.

Figure 2:
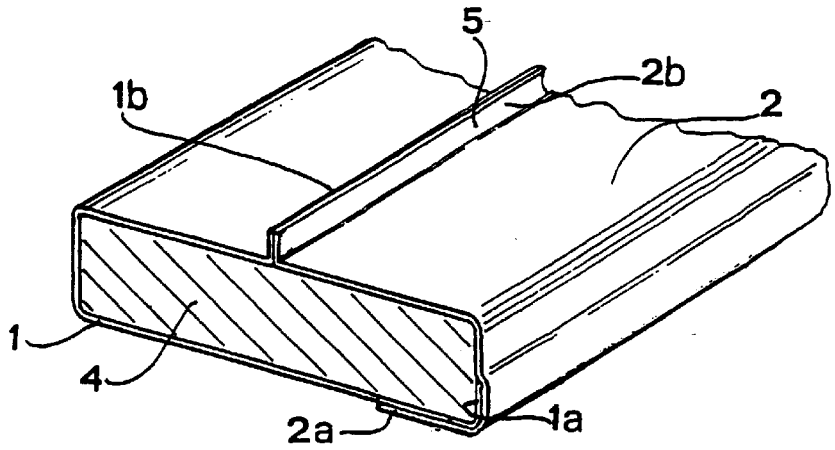
FIG. 2 is also a diagrammatic illustration and a perspective view of the second stage thereof that is the wrapping around the product for carrying out a recloseable envelope around a product.

The sheets 1 and 2 are chosen in a sufficient sizes so that the second end edge regions 1*b* and 2*b* of the sheets 1 and 2 respectively can overlap to a sufficient degree, thus forming a tight enclosure around the product, such as to allow the formation of a solid adhesive joint among the same edge regions throughout the length of the product, having the shape of a "fin seal" 5 (FIG. 2)

Figure 3:
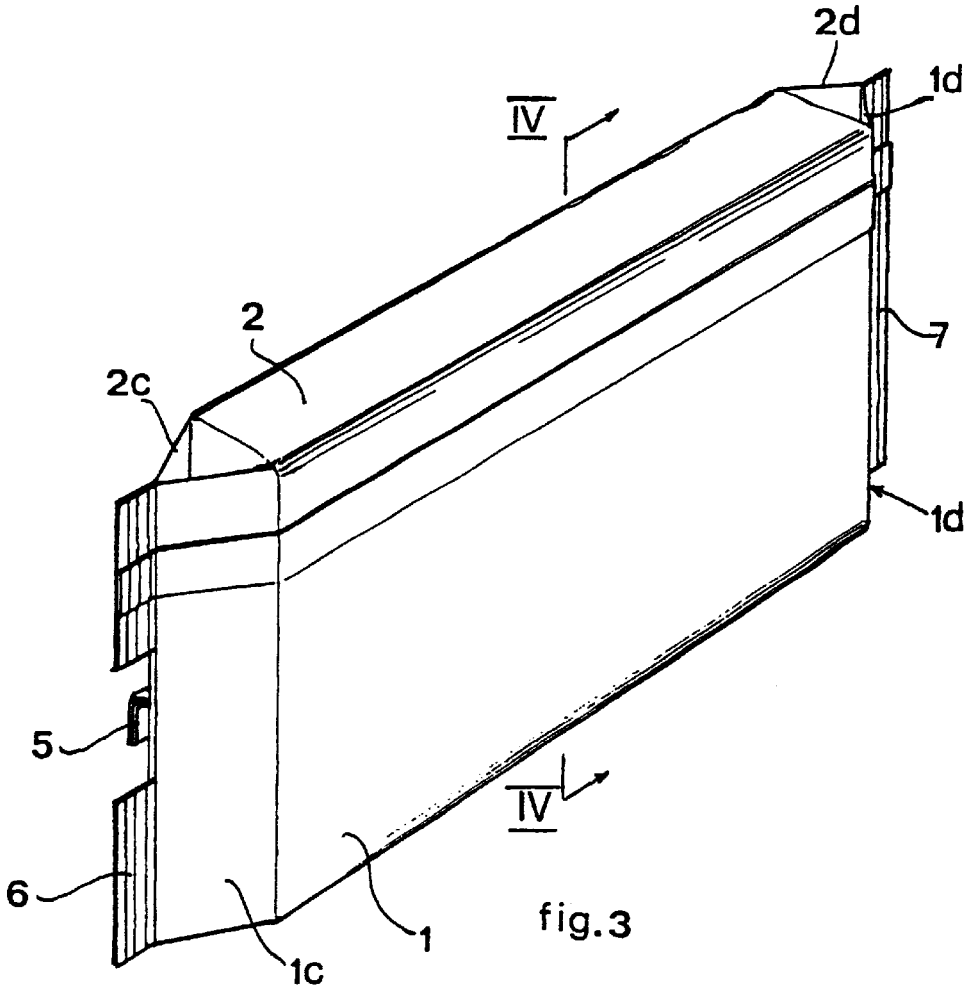
FIG. 3 shows a perspective view of a finished package, air-tight and re-closeable, obtainable through the method of the invention.

The formation of the fin seal is carried out after letting the partly wrapped up product through a second adhesive station of the known type. The product 4, not completely wrapped up , as illustrated in FIG. 2, is then fed up at one or more subsequent adhesive stations of the known type, in which the end edge regions 1*c*–2*c* and 1*d*–2*d* are folded over themselves so as to overlap on the opposite sides of the product, in order to form the "end seals" 6 and 7, as illustrated in FIG. 3. The extent of overlap of the first two side edges 1*a*–2*a* of the sheets is fixed to a sufficient degree so as to allow the sheets themselves to be tightly folded over the product 4 to wrap it and to ensure a sufficient overlap and a tight junction of the second end edges 1*c*–2*c* and 1*d*–2*d*.

Figure 4:
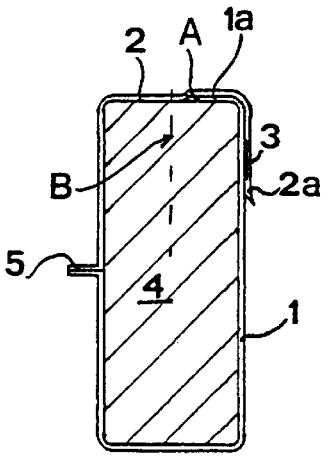
FIG. 4 shows a transversal section view according to lines IV—IV of FIG. 3.
Figure 5:
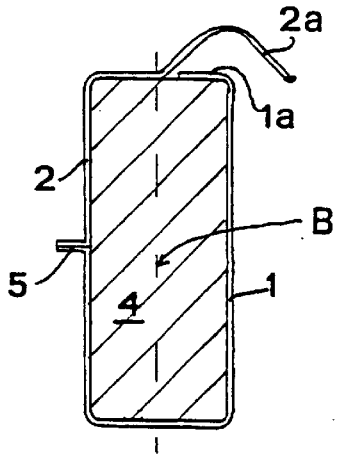

It is preferable to position the separable seal 3 in proximity of one of the corners of the product 4; yet, other positions suitable to fulfil the needs of opening and closing by raising the edge region 2*a* of the outermost of sheet 2, as illustrated in FIGS. 4 and 5, can be provided.

In fact, by raising the outermost of the edge region 2*a,* a separation thereof from the underlying edge region 1*a* of the sheet 1 (FIG. 5) is caused, thus forming an opening in the package and, since the end portion of A of the edge region 1*a,* protruding from the side 4*c* of the product, is foldable, inside or outside, of the opening itself, the drawing can be made throughout the length and depth of the packaging. In this case the package takes a substantially parallelepiped shape (FIG. 3) for solid products of any shape. In order to ensure the free oscillation of the end portion A, the extent of overlap of the portion 1*a* of the interior sheet 1 on the side of the product 4*c* (FIG. 2) must be limited at the most to the medium line b of the same product (FIGS. 2–4 and 5), otherwise, the same portion A would be included among the end edges 1*c*–2*c* and 1*d*–2*d* during the closing of the same and could not result to be free to oscillate anymore to allow the total or more or less total opening of the packaging and consequently the full length, depth and width access to the product, as previously said.

Figure 3A:
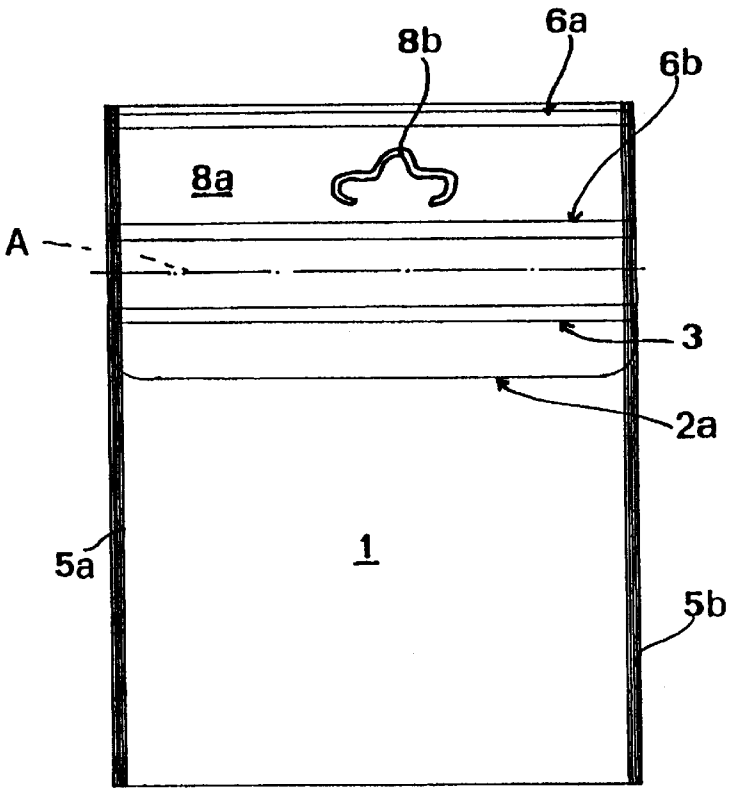
FIG. 3*a* shows a frontal view of a different embodiment of the package obtainable through the process in object.
Figure 2A:
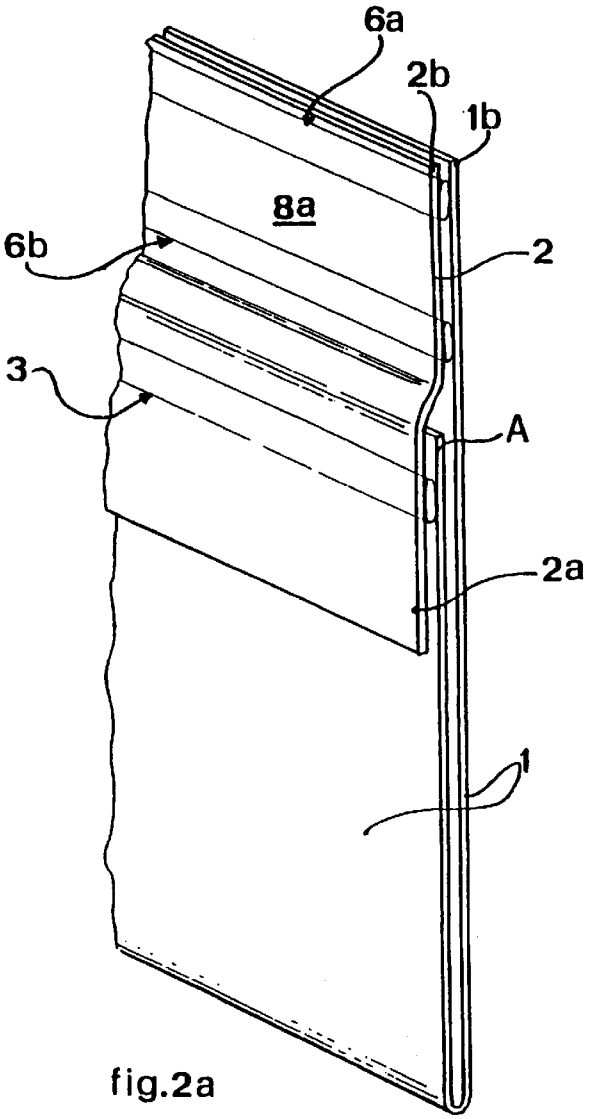
FIG. 2*a* shows a section view of a different product wrapping method.

Still according to the present invention, the above described packaging method can allow the formation of also a bag-shaped package or the like, as illustrated in FIGS. 2*a* and 3*a*.

In this case, the outermost of sheet 1 is formed in much wider sizes with respect to the innermost sheet 2, more precisely, said wide sheet 1 (FIG. 2*a*) is folded over itself, in such a way as to form a bag or an envelope, whose end portion A, overcoming the lap seal 3, keeps free, whereas the sheet 2, of much more reduced sizes, is tightly sealed to the sheet 1 by means of two end seals 6*a* and 6*b;* the seal 6*a* links firmly the end edges 1*b*–2*b* of the external sheet and of internal sheet, while the seal 6*b* links the same sheets 1 and 2 to each other, defining a region of overlapping sheets therebetween, indicated with 8*a* in FIGS. 2*a*–3*a,* on which an opening or a punching 8*b* can be obtained as a means to hang the package to claws and/or hooks of shelves or similar supports. The two longitudinal side edges of the interior sheet 1, overlapping each other as in FIG. 2*a,* are thereafter sealed to form two longitudinal junctions 5*a*–5*b* (FIG. 3*a*).

Also in this case, the junction of the edge region 2*a,* separable from 1*a* of the underlying one, is carried out in such a position as to leave the end portion A of the side edge 1*a* free, for the reasons already explained with respect to FIG. 3.

For carrying out the process able to bring to an airtight packaging openable and re-closeable such as that definitively illustrated in FIGS. 3 and 3*a,* there is provided a packaging apparatus, according to the present invention, which can be directly associated upstream of a packaging machine already known for the production of envelopes of flexible material for solid products, in blocks or loose, that is to say of a machine which provides a series of working stations for realising the forming, filling and sealing, both horizontally and vertically and starting from sheets or bands of various flexible materials, until different types of air-tight envelopes for different products are obtained.

The apparatus object of the present invention is substantially constituted by a supporting frame 8 (FIG. 6) to which two spools 9–10 of flexible sheet or band of different material are associated, and more precisely of the sheet 1 and of the sheet 2, respectively; said spools 9–10 are freely mounted rolling around the horizontal parallel axes 9*a*–10*a,* adjacent to each other and staggered so as to allow both sheets to unfold in a horizontal plane 11 and, at the same time, sheet 2 to partly overlap sheet 1, in order to constitute two longitudinal side edges (or strips) 1*a*–2*a* (as indicated in FIG. 1) overlapping each other. The unfolding of the two sheets 1 and 2 is intermittently carried out by the organs of the packaging apparatus arranged to this end, which apparatus is located downstream of said spools and is not illustrated as being widely known in the field of automatic packaging.

Said spools 9–10 are moreover axially mounted in a translatable fashion with respect to each other so that the extent of overlap of the edge regions 1–2 can be varied; additionally, to each spool a braking roll is associated by contact 12 and 13, acting on the underlying sheet, so as to ensure the regularity of the unfolding.

The so partly overlapping sheets are then deviated around a loose needle-roller and to a horizontal axis 14, thereafter they are inserted between two further needle-rollers 15–15*a* which carry out, by simple contact, the lap seal 3, that is a sealing which allows to separate one edge region to be separated from the other, and thereafter to re-seal them.

This kind of sealing, known as "lap seal" results to be possible when at least one of said sheets is constituted by a laminated plastics film which, as known, has the property of sealing two overlapping layers by adhesion, as well as of being separate from the underlying film and of being thereafter sealed again.

In the case of two sheets of different material, the junction of the same can be effected though the employment of a sizing agent or other known systems which allow the separation and the hermetically sealing of the same sheets.

Downstream of the sealing station of the two edge regions, worked out between said first parallel pressure needle-rollers 15–15*a,* known feeders and/or shacklers (not represented) are provided, aimed at transferring said sealed sheets to the subsequent stations of moulding, filling with the product and sealing, until a complete air-tight envelope around the product is formed , such as that illustrated for example in FIG. 3.

Figure 6:
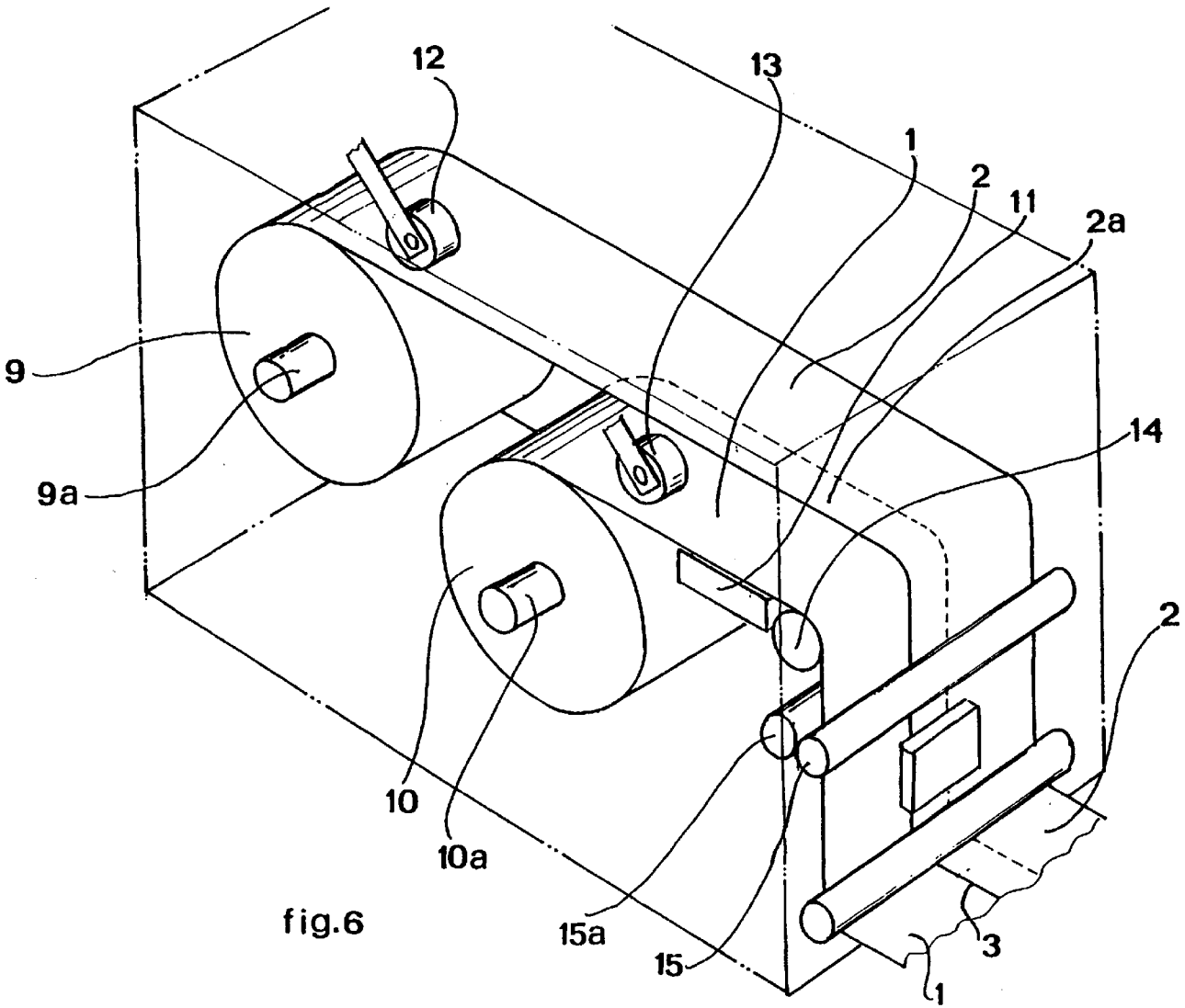
FIG. 6 shows a diagrammatic perspective view of the apparatus provided for carrying out the starting stage of the packaging production claimed by the present invention, destined to be associated upstream of a packaging machine, of the known type, suitable for forming, filling, sealing the edge regions of a traditional packaging.

The apparatus above described and illustrated in FIG. 6 is also associated to a packaging machine of the known type already arranged for joining second the end edge regions 1*b* and 2*b* through a so called "fin seal", and the joint between the transversal edge regions with the longitudinal ones, indicated as 1*c*–2*c* and 1*d*–2*d* in FIG. 1, by means of heat sealing, ultrasonic and through adhesiveness by sizing agent, in order to form the end seals 6–7 (FIG. 3).

Finally, the package which can be re-opened and resealed again after each partial drawing of the product, can take also different shapes other than the parallelepiped one or bag-like above described and can contain various types of food products, for instance cheese slabs, rusks, biscuits and the like, as well as granular and also powder products.

What is claimed is:

1. A process for the application of an air-tight wrapping material around a product of various shape and consistency, for the production of a package which can be opened and hermetically closed again after each partial drawing of the product, comprising:

using as flexible wrapping material a first and a second quadrangular sheets (2, 1) of different material, of which at least one is a laminated sheet and made of a material which can be separated from the other;

locating said first and second sheets (2, 1) in a partly overlapping position in adjacent and parallel planes, in such a way that a first longitudinal side edge (2*a*) of said first sheet (2) overlies a first longitudinal side edge (1*a*) of said second sheet (1);

joining said first longitudinal side edges (2*a,* 1*a*) so that they result to be separable one from the other once the package is then completed using hermetically resealable adhesive;

placing the product (4) to be packaged on said partly overlapping and extended sheets and folding said sheets around the product until the opposed two second longitudinal side edges (2*b,* 1*b*) of said sheets (2, 1) fit together;

stably joining said opposed two second longitudinal side edges (2*b,* 1*b*) to each other forming a seal;

folding and stably joining the extended ends, protruding from the opposed ends (1*c,* 2*c*) (1*d,* 2*d*) of the partly wrapped product, so forming two opposed end closings or terminal edges (6, 7);

so as to obtain a substantially parallelepiped package, hermetically sealed, which can be opened and closed again through separation and raising of said first longitudinal side edge (2*a*), of said first sheet (2), exterior with respect to said first longitudinal side edge (1*a*) of said second sheet (1).

2. A process according to claim 1, wherein the outermost of said first longitudinal side edge (2*a*) is joined to the underlying one (1*a*) by mutual adhesion, by means of a seal, or through a light sizing agent or similar adhesive, in order to be separated and re-sealed again to the underlying one.

3. A process according to claim 1, wherein the extent of overlap of said first side edge (2*a*) of said first sheet (2) to the underlying said first side edge (1*a*) of said second sheet (1) is of such a value as to allow, after separation and raising of said exterior first side edge (2*a*) of said first sheet, to gain access to the product stored inside the package.

4. A process according to claim 1, wherein said first side edges (2*a,* 1*a*) are joined (3) in proximity of a corner or side (4*c*) of the product (4), so as to allow, by separating the outermost of the edge region (2*a*), to gain full length, height and depth access to the product.

5. A process according to claim 1, wherein said opposed two second longitudinal side edges (1*b,* 2*b*) of said overlapping sheets (2, 1) are joined and adhesived to form seal (5), whereas the transversal edges (1*c,* 2*c*) (1*d,* 2*d*) of said sheets (2, 1) are sealed to form terminal edges (6, 7), perpendicular to said seal (5).

6. A process for the application of an air-tight wrapping material around a product of various shape and consistency, for the production of a package which can be opened and hermetically closed again after each partial drawing of the product, comprising using as flexible wrapping material a first and a second quadrangular sheets (2, 1) of different material, of which at least one is a laminated sheet and made of a material which can be separated from the other;

locating said first and second sheets (2, 1) in a partly overlapping position in adjacent and parallel planes, in such a way that a first longitudinal side edge (2*a*) of said first sheet (2) overlies a first longitudinal side edge (1*a*) of said second sheet (1), a portion(A) of said underlying sheet (1) being left foldable inside the package;

joining said first longitudinal side edges (2*a,* 1*a*) so that they result to be separable one from the other once the package is completed using hermetically resealable adhesive;

said first and second quadrangular sheets (1, 2) being different in size so as to allow said second edge (1*b*) of said underlying second sheet (1) to be folded over itself and stably joined to said second side edge (2*b*) of said overlying first sheet (2);

stably joining said opposed two second longitudinal side edges (2*b,* 1*b*) to each other forming a seal (6*a*);

folding and stably joining the transversal edges of said sheets (2, 1), in order to form two opposed terminal edges (5*a,* 5*b*);

providing for a sealing (6*b*) between said seal (6*a*) and said joining (3) of the first longitudinal side edges (2*a,* 1*a*), so as to define a plane region (8*a*) aimed at receiving an opening, constituting a means to hang the packaging to various supporters;

so as to obtain a substantially parallelepiped package, hermetically sealed, which can be opened and closed again through separation and raising of said first longitudinal side edge (2*a*) of said first sheet (2), exterior with respect to said first longitudinal side edge (1*a*) of said second sheet (1).

* * * * *